US006817872B1

(12) United States Patent
Berg

(10) Patent No.: US 6,817,872 B1
(45) Date of Patent: Nov. 16, 2004

(54) HEAT PROTECTIVE SPARK PLUG EXTENSION

(76) Inventor: Steven Michael Berg, 4603 S. Magnolia St., Spokane, WA (US) 99223

( * ) Notice: Subject to any disclaimer, the term of this patent is extended or adjusted under 35 U.S.C. 154(b) by 0 days.

(21) Appl. No.: 10/702,404

(22) Filed: Nov. 5, 2003

(51) Int. Cl.[7] ..... H01R 13/44
(52) U.S. Cl. ..... 439/125; 439/32; 439/11
(58) Field of Search ..... 439/125, 32, 11

(56) References Cited

U.S. PATENT DOCUMENTS

| | | | | |
|---|---|---|---|---|
| 1,994,882 A | | 3/1935 | Cadieux | |
| 2,459,214 A | | 1/1949 | Bickle et al. | |
| 3,076,113 A | | 1/1963 | Candelise | |
| 4,394,598 A | | 7/1983 | Bergmann | 313/51 |
| 4,413,870 A | * | 11/1983 | Labutski, III | 439/11 |
| 5,357,233 A | * | 10/1994 | Wada | 336/107 |
| 6,068,495 A | * | 5/2000 | Virchow | 439/125 |
| 6,210,183 B1 | | 4/2001 | Sacarto | 439/127 |

FOREIGN PATENT DOCUMENTS

| | | |
|---|---|---|
| FR | 707801 | 4/1931 |
| FR | 837543 | 11/1938 |

* cited by examiner

*Primary Examiner*—Tho D. Ta
(74) *Attorney, Agent, or Firm*—Reidlaw, L.L.C.; John S. Reid

(57) ABSTRACT

A heat resistant spark plug extender is described, for joining a spark plug like ignition device to a spark plug wire. The extender includes an elongated body formed of heat resistant and electrically insulative material that extends between a spark plug engagement end and a spark plug wire connector end. A conductor is located within the body and includes a fitting, adapted to releasably electrically connect to a spark plug wire, and a receptacle, adapted for electrical connection to a spark plug. An adjustment part permits adjustable movement of the spark plug wire connector end relative to the conductive receptacle.

24 Claims, 6 Drawing Sheets

HEAT PROTECTIVE SPARK PLUG EXTENSION

FIELD OF THE INVENTION

The invention claimed and disclosed herein pertains in general to extending the connector base ends of spark plug wires to provide electrical connection for spark plugs and to protect the spark plug wires against heat damage from internal combustion engine exhaust manifolds and headers.

BACKGROUND

Spark plug wires have flexible electrically insulative coatings that are intended to be heat resistant. However, exhaust manifolds or headers often reach temperatures far in excess of the wire insulation's heat resistivity. Spark plug wires that come too close to exhaust manifolds or headers are typically damaged and thus destroyed. Melted wire insulation exposes the internal conductor, which can short out or arc and severely affect the intensity of the ignition spark. Poor spark quality translates to reduced performance and poor fuel economy for the associated engine.

Numerous spark plug extenders have been developed for deep spark plug wells, especially in modern overhead valve engines. Many such extenders are provided as integral parts of the spark plug wires, or as separate members that function as extended spark plug caps, simply to provide access for spark plug wire connection. The extenders are typically intended for a particular engine configuration, are not universally adaptable, and do not have heat resistant qualities.

Lack of adaptability in spark plug extenders is a problem especially considering the numerous aftermarket exhaust headers presently available on the market. Some after market "block hugger" exhaust headers are designed to fit in confined spaces and crowd the spark plugs. Large diameter performance headers also tend to be intrusive and limit spark plug and connector wire access.

The above problems point to a need for an extender that will allow spark plug wire connection in a variety of spatial circumstances, at locations remote from the spark plug ends. A need also exists for extenders that will function well in high heat conditions.

The present invention, as will be understood below, provides a new and nonobvious solution to the above problems. And, while achieving the benefits derived from other known methods and devices, the present invention avoids the shortcomings and detriments individually associated therewith.

SUMMARY

One embodiment of the invention provides for a spark plug extender ("extender") for joining a spark plug connector end to a spark plug wire socket. The extender includes an elongated body formed of a heat resistant and electrically insulative material extending between a spark plug engagement end and a spark plug wire connector end. An electrical conductor extends within the body from the spark plug engagement end to the spark plug wire connector end. The conductor includes a fitting at the sparkplug wire connector end adapted to releasably electrically connect to a spark plug wire, and further includes a conductive receptacle at the spark plug engagement end, adapted to electrically connect to a spark plug. An adjustment part is disposed along the body between the spark plug engagement end and the spark plug wire connector end, permitting adjustable movement of the spark plug wire connector end relative to the conductive receptacle.

In another aspect, the invention includes a spark plug extender for joining a spark plug connector end to a spark plug wire socket, in which an elongated body formed of heat resistant and electrically insulative material extends between a spark plug engagement end, and a spark plug wire connector end. An electrical conductor extends within the body from the spark plug engagement to the spark plug wire connector end, and includes a fitting at the spark plug wire connector end adapted to releasably electrically connect to a spark plug wire. The conductor also includes a conductive receptacle at the spark plug engagement end, adapted to electrically connect to a spark plug. An adjustment part is provided, comprised of a pivot joint disposed along the body between the spark plug engagement end and the spark plug wire connector end. The adjustment permits movement of the spark plug wire connector and the conductive receptacle about a pivot axis that intersects with the elongated body.

A further aspect of the invention provides for a spark plug extender for joining a spark plug to a spark plug wire, in which an elongated body ("body") is formed of heat resistant and electrically insulative material, and extends between a spark plug engagement end, and a spark plug wire connector end. The body includes two pivotably interfitting body sections joined together for pivotal movement about a pivot axis. An electrical conductor extends within the body to the spark plug engagement end and the spark plug wire connector end, and includes two pivotably interfitting conductor sections. The conductor sections are joined together for pivotal movement substantially about the pivot axis. One conductor section includes a fitting at the spark plug wire connector end. The fitting is adapted to releasably electrically connect to a spark plug wire. The remaining conductor section includes a conductive receptacle at the spark plug engagement end, adapted to electrically connect to a spark plug. The interfitting sections of the body and conductor comprise an adjustment part which includes a pivot joint disposed along the body between the spark plug engagement end and the spark plug wire connector end. The pivot joint permits relative movement of the spark; plug wire connector end and the conductive receptacle about the pivot axis.

The above and further aspects and embodiments will next be described in detail with reference to the accompanying drawings which, taken along with the following detailed description and claims, disclose the best mode presently known for carrying out the invention.

DETAILED DESCRIPTION

Figure 1:
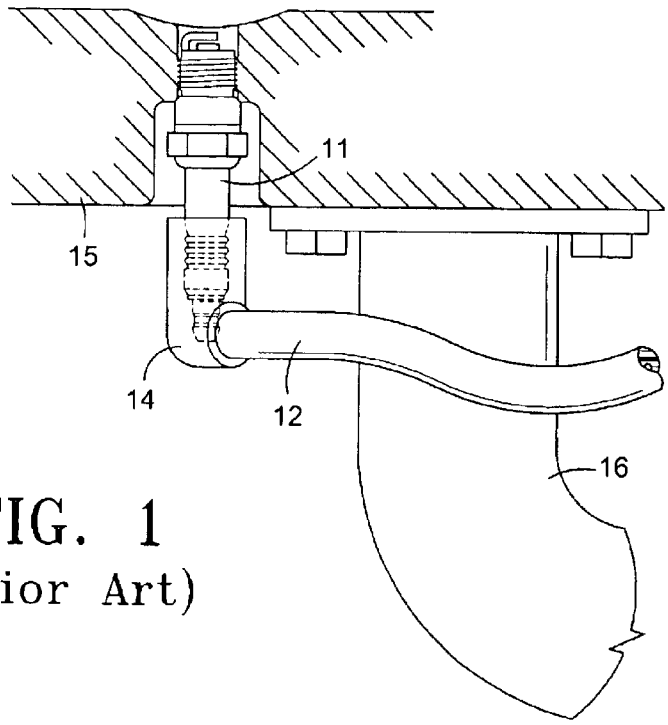
FIG. 1 (Prior Art)
FIG. 1 is a schematic view of a prior art spark plug and spark plug wire connection, showing proximity to an exhaust header.

Looking now to the drawings in greater detail, attention is first drawn to FIG. 1 where a schematic representation is made as background to the following description of various aspects of my invention. FIG. 1 depicts, in diagrammatic form, an ignition device, such as a spark plug 11, mounted to a sectional part of an engine head 15. The spark plug 11 (which can also be a glow plug in the case of a diesel engine) is connected to a common ignition or spark plug wire 12. The spark plug wire 12 (partially shown) normally includes a cap that snaps over the exposed end of the spark plug 11. The spark plug wire 12 is typically insulated and leads from the cap or socket 14 to a source of electrical energy such as a distributor (not shown).

It is typical, at least in many "V8" engines, that the spark plug wires must pass by the engine exhaust manifold or header 16. There are many stock and after-market exhaust manifolds 16 that present various degrees of obstruction for the spark plug wires 12. It is not unusual that a spark plug wire 12 will unintentionally or unavoidably become too close to the exhaust header or manifold, which can reach very high temperatures during engine operation. FIG. 1 shows the spark plug wire 12 and a typical plug connector socket 14 in such close proximity that the header 16 could easily damage or melt the insulation and expose the wire core. An exposed conductive core of a spark plug wire 12 can easily short circuit on contact or arc to an adjacent conductive spark (such as the exhaust header) and misfire will undoubtably occur. Engine performance and efficiency is dramatically affected by short circuited spark plug wires.

Figure 2:
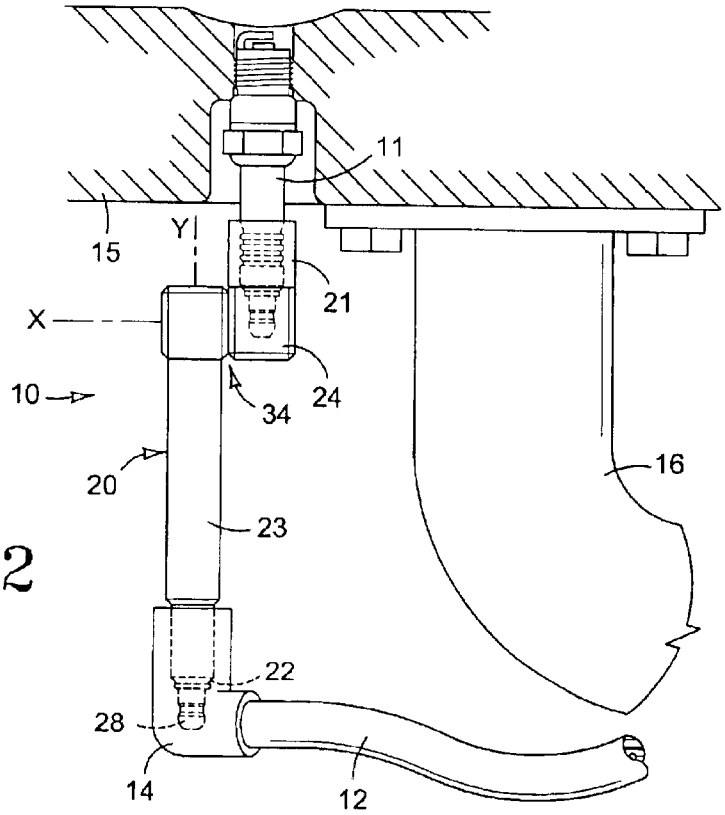
FIG. 2 is a schematic view of the same spark plug and header relation, but with an exemplary form of a spark plug extender ("extender") in accordance with an embodiment of the present invention mounted between the spark plug and spark plug wire.

The spark plug extender ("extender) 10 of the present invention, as exemplified herein, is provided to space the spark plug cap 14 and wire 12 out of harm's way as depicted in the schematic view of FIG. 2. To this end, an exemplary configuration of the extender 10 is illustrated FIG. 2 which, compared to the arrangement shown in FIG. 1, is mounted between the spark plug 11 and the same spark plug wire 12. As can be seen, the present extender 10 functions to space the wire 12 and its socket 14 in a lower temperature environment away from the exhaust header 16. It can also be seen that the extender 10 allows for easier access for attachment and detachment of the sparkplug wire socket 14.

Figure 3:
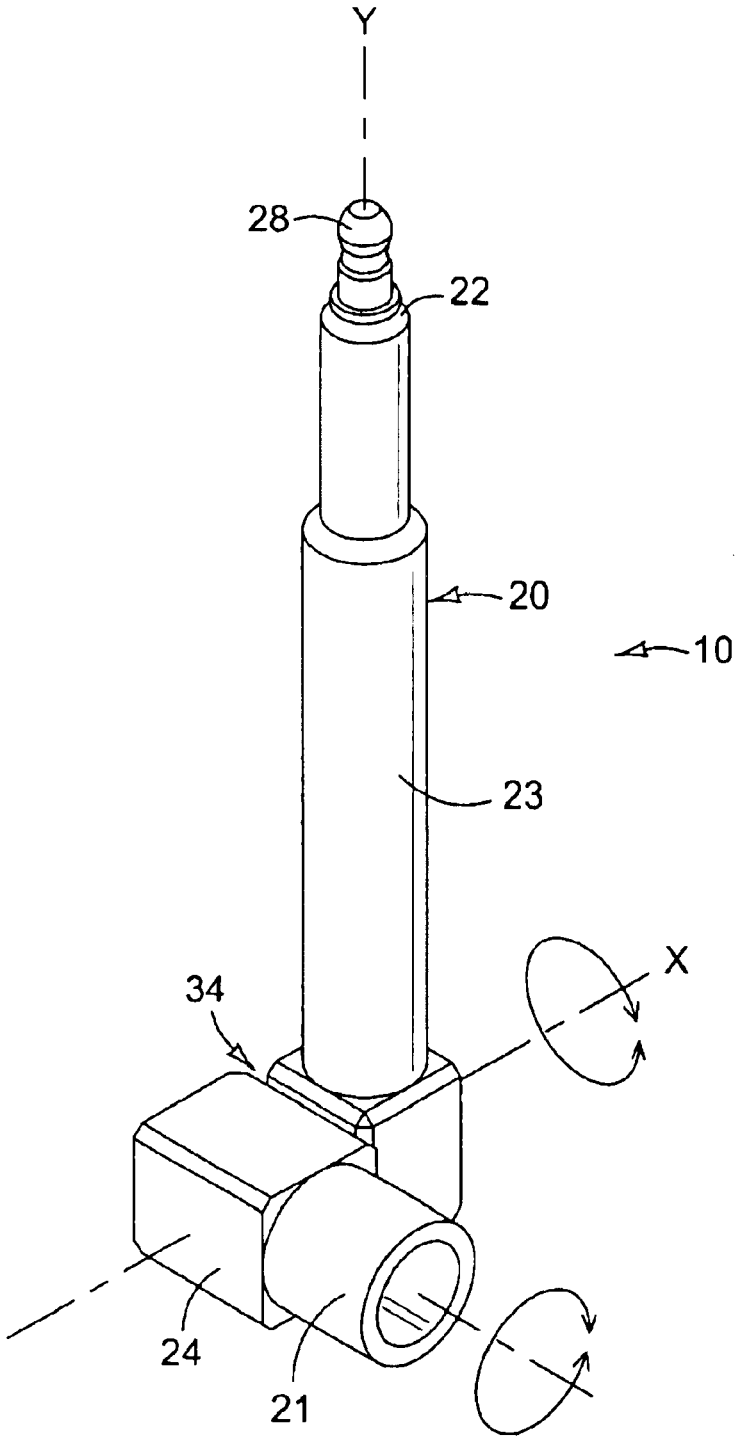
FIG. 3 is a perspective view depicting an exemplary arrangement for the extender.
Figure 4:
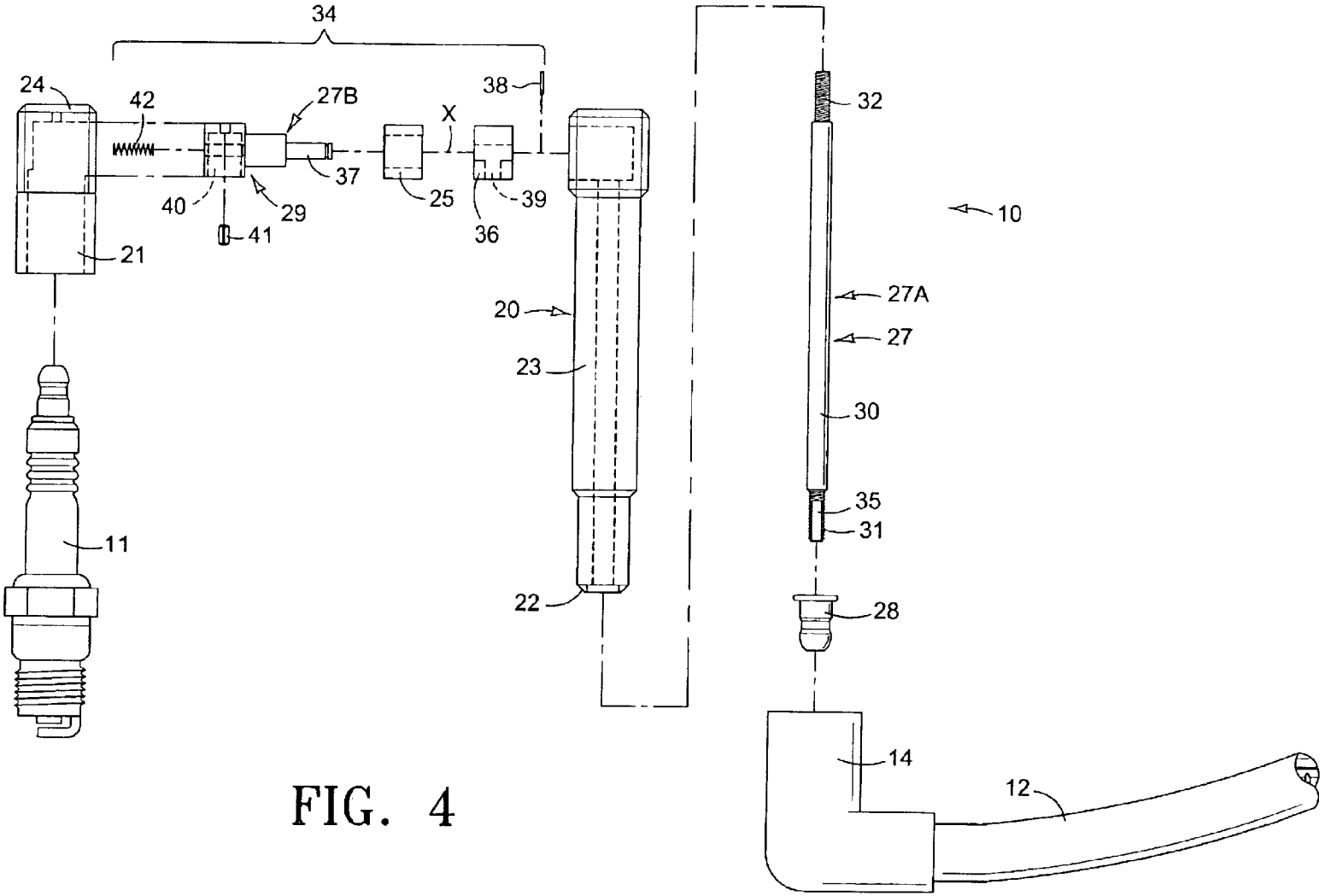
FIG. 4 is an exploded orthographic view including a spark plug and spark plug wire.
Figure 5:
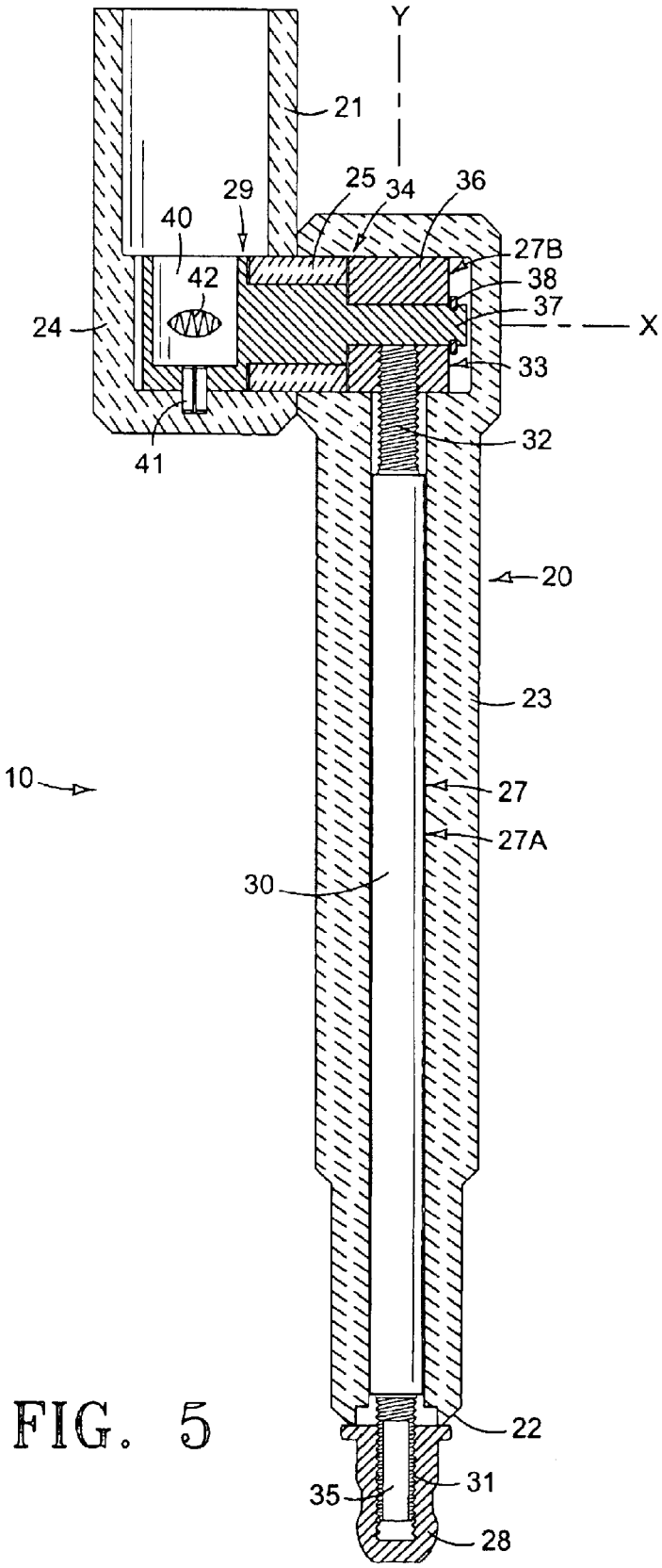
FIG. 5 is an enlarged cross sectional view depicting exemplary internal components.
Figure 6:
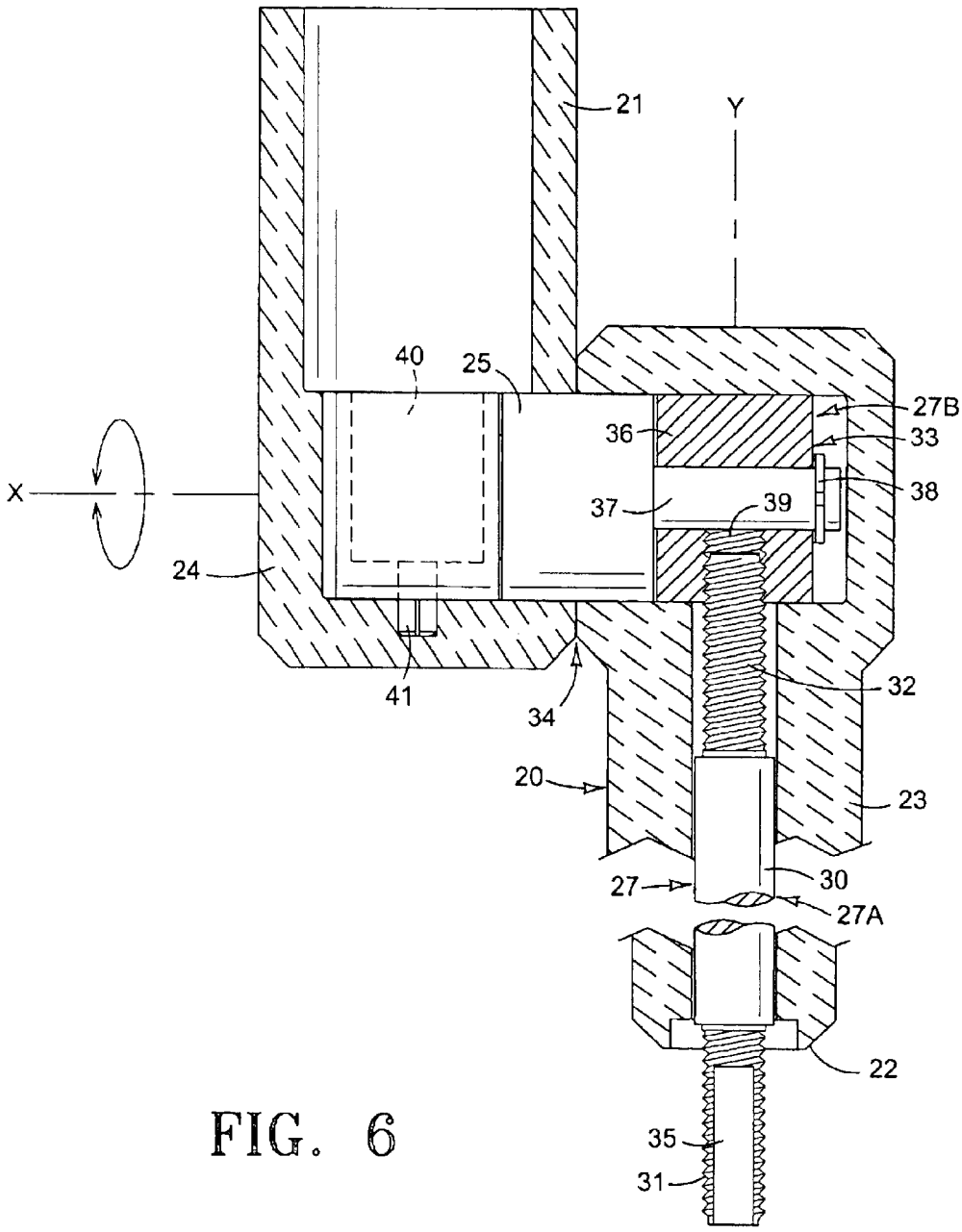
FIG. 6 is a sectional view depicting an exemplary lock or clamp adjustment by which the illustrated components are released for selective rotational adjustment.

In FIGS. 3 and 5, general aspects of the extender 10 are illustrated, including a body 20 that is formed of a heat resistant and electrically insulative material, extending from a spark plug engagement end 21 to a wire connector end 22. As depicted, the body 20 is presented in basically two sections: an elongated section 23 that includes the wire connector end; and a short section 24. A spacer hub 25 (see FIGS. 4–7) can be pivotably fitted between the two sections 23, 24 as part of a pivot joint 34 that allows relative pivotal motion of the sections 23, 24, and maintains electrical and thermal insulation for the conductor 27 carried inside.

It is pointed out that the particular construction for the body 20 illustrated in the drawings is but an example, and that other configurations can be used without departing from the scope of my invention. For example, more than two sections can be used, or the sections can have approximate equal length components. It has been found, however that the arrangement illustrated herein is preferred, at least at the present time, for maximum adaptability to different engine head, exhaust manifold, or header configurations.

In one aspect of the present invention, the body 20 is formed of a rigid, heat resistant and electrically insulative material. In a more particular example, a useful material including heat resistive and electrical insulative properties can be a ceramic comprising alumina oxide, which is capable of being formed in the configurations depicted herein. Ceramic with alumina oxide is an advantageous material to use in forming the body 20 since alumina oxide can be machined to provide passageways for the internal conductor 27, and close-tolerance fit of rotational components. Additionally, it is sufficiently strong to allow for a slim, compact construction.

The body sections are formed to minimize overall dimensions, thereby providing for use of the extender 10 in confined areas. To this end, the overall maximum lateral width (measured along the axis X) in one preferred example can be about 1.25 inches. The diameter or cross sectional dimensions for the long body section 23 may also be minimal. In one preferred example the long body section 23 has an external diameter of about 0.5 inches. Overall length can vary according to need, but a preferred exemplary long dimension is about 5 inches with the body sections fully extended as shown in FIG. 5.

It is also pointed out that the spacer hub 25 illustrated in FIGS. 4–7 is shown separate from the two body sections 23, 24. It is understood, however that other configurations can also be utilized wherein the spacer hub 25 is integral with one or the other, or both, of the body sections 23, 24 to accomplish the function of permitting relative pivotal movement there between while insulating the internal conductor 27.

Attention is now drawn to FIGS. 4, 5 and others, where aspects of an exemplary conductor 27 are shown. In general terms, the conductor 27 is an electrically conductive element that is used to conduct electrical current from a spark plug wire 12 to an associated spark plug 11. To this end, preferred forms of the conductor 27 have provisions at opposed ends for enabling releasable connection to the spark plug 1;1. It will be seen that the illustrated versions extend from the fitting 28 (which can be in the form of a conventional spark plug end nut) at the first body end 22 to a conductive receptacle 29 at the second body end 21. A socket part of the receptacle 29 is depicted as being shaped for electrical reception by a conventional spark plug end nut.

In the illustrated embodiments, the conductor 27 is mounted within respective body sections 23, 24. The conductor 27 can be in two sections, in which case one conductor section 27A includes the electrode 30 which is mounted within the body section 23, and the other conductor section 27B includes the conductive receptacle 29 which is depicted within and laterally spanning both body section 23, 24. The body 20 and conductor sections thus can be arranged, as illustrated, to permit relative adjustment about a pivot axis "X".

Preferred materials making up the conductor 27 can include a rigid conductive metal, such as stainless steel, which is conductive, heat resistant, corrosion resistant, and has strength properties useful in the most preferred conductor configurations. Other conductive materials such as copper or aluminum can also be used, but stainless steel is advantageous in this application due to its higher heat resistivity, corrosion resistance, and superior strength.

To further assure high heat resistance and strength, the conductor can be formed as a rigid stainless steel rod with a diameter of approximately 0.135–0.185: inches. Within that range, it is particularly advantageous for the conductor to have a continuous diameter of approximately 0.156 inches. A rod (especially of stainless steel): of this diameter has a desirable combination of good strength and high heat resistance without adding significant bulk to the finished product.

Fitting 28 is a preferred component of the conductor 27 and can be an off-the-shelf spark plug end nut, threaded onto the conductor 27 at the body end 22. The depicted standard nut configuration facilitates use of the present extender 10 without requiring modification of conventional spark plug wire sockets 14 or wires. Further, the releasable threaded union between the fitting 28 and an elongated electrode 30 of the conductor allows use of the fitting 28 to secure adjusted orientations of the extender 10 (discussed in greater detail below).

The electrode 30 can be formed of an elongated rigid rod, with threads at opposed ends. One end 31 can be threaded to receive the fitting 28, and the opposed end 32 can be threadably engaged within a complimentary threaded bore 39 (FIG. 6) which is formed in a bushing part 36 of the conductive receptacle 29. The electrode can be of a length selected to be slightly longer than the body section 23, so the threaded end 31 will project outwardly to receive the fitting 28. The opposite end 32 is positioned to move in response to rotation of the electrode 30, against and away from a spindle part 37 of the conductive receptacle 29.

In preferred forms, the rod and other parts of the conductor 27 can be loosely received within complimentary parts of the body 20. The loose fit is provided advantageously to: accommodate differential in thermal expansion between the conductor and the ceramic body 10; to allow for relative movement (such as rotation of the electrode 30); provide an air buffer between the ceramic body and the adjacent surfaces of the conductor; and to facilitate assembly.

Figure 7:
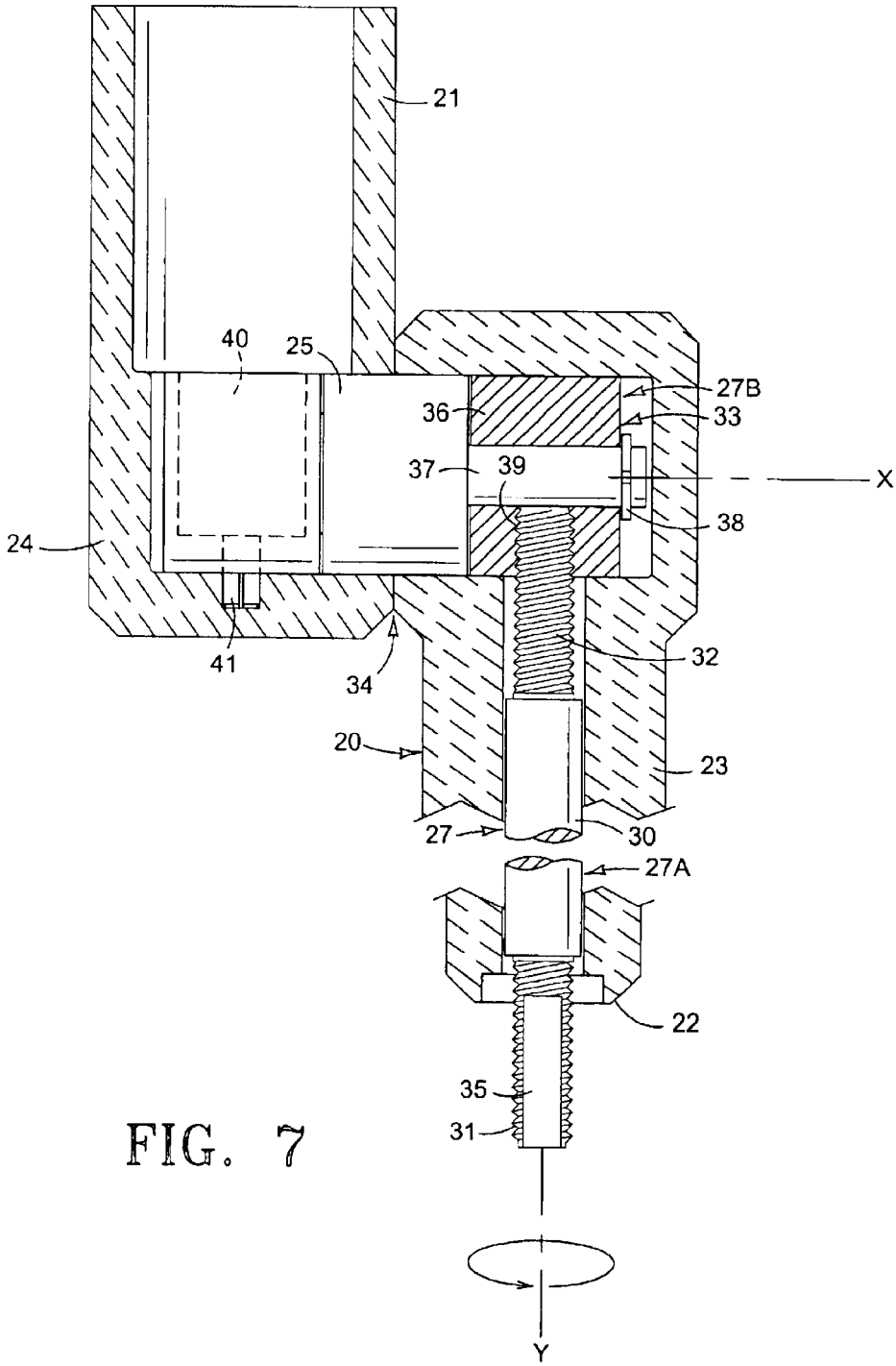
FIG. 7 is a sectional view similar to FIG. 6 only showing the exemplary components in a secured condition.

As depicted in FIGS. 4, 5 and 7, the exemplary electrode 30 includes tool engaging flats 35 at end 31. The flats 35 can be formed along the threaded end 31 and are spaced outwardly of the body end 22 to permit engagement by a tool such as a wrench or pliers (not shown). While the flats 35 are presently preferred for tool access, it is possible also to provide other configurations such as a screwdriver access slot on the end 31, to permit tool access for turning the rod.

The flats 35, electrode 30, and receptacle 29 can be considered as elements of an adjustment part 33 (FIGS. 5–7) which is disposed along the body 20 between the spark plug engagement end 21 and the spark plug wire connector end 22 to permit adjustable movement of the electrode 30 and body section 23 relative to the conductive receptacle 29. The flats 35 permit use of a tool to turn the electrode 30 about its long axis, thereby locking or unlocking the pivotable sections 23, 24 and respective conductor sections 27A, 27B for adjustment purposes.

Components described above also lend themselves to use as a selective locking arrangement by which the relatively pivotable sections can be adjusted and then locked in position. For example, the elongated electrode 30 can be turned by engaging the flats 35 with an appropriate tool, to release clamping pressure against the spindle. This action results in an ability to pivotably adjust the long body section 23 angularly about the axis X with respect to the laterally adjacent short section 24. Once the desired angular adjustment is acquired, the same tool can be used to re-clamp the electrode 30 against the spindle 37, thereby locking the two sections together.

Relative pivotal motion of the conductor sections 27A and 27B, and body sections 23, 24, is permitted by the pivot joint 34, as briefly noted above. The joint 34 can incorporate elements of the heat resistant body 20, and parts of the conductor 27. In the illustrated example, part of the joint 34 is comprised of the bushing 36, which threadably receives the electrode end 32. Spindle 37 can be rotatably journalled by the bushing 36, which is depicted as an integral part of the conductive receptacle 29.

The bushing 36 can be held in place along the spindle 37 by a fastener such as a spring clip 38, as suggested in FIGS. 4–7. The bushing 36 defines a bushing bore into which opens the threaded electrode end receiving aperture 39. Threads within the aperture 39 co-act with the threaded electrode end 32 so that selective rotation of the electrode 30 can bring the electrode end 32 into or away from clamping engagement with the spindle 37. Such action serves to lock and unlock the two conductor sections 27A, 27B against respective pivotal motion about the axis "X". The threaded connection also helps hold the conductor and body sections together against separation along the axis "X".

The bushing 36, spindle 37 and spacer hub 25 (and the sockets formed in the body sections to receive them) are illustrated as defining the pivot axis "X" by which the body sections 23, 24 and conductor sections 27A, 27B pivot. With these components aligned as in the example depicted in the drawings, the pivot axis "X" is substantially perpendicular to the electrode 30 and is disposed toward the spark plug connector end 21 of the heat resistant body 20.

The above arrangement of components, along with the selected electrically insulative and conductor materials allow for the short body section 24 and the spark plug socket part 40 of the conductive receptacle 29 to be laterally offset in relation to the electrode 30, while also allowing for a slim extender profile that lends itself to placement in confined areas. Further, as depicted in FIGS. 2 and 5, the body sections 23, 24 can be offset with respect to one another at the pivot joint 34.

It is noted that the preferred angular orientation of the axis "X" is shown to be perpendicular to the electrode axis "Y". Other angular orientations can be incorporated, but the perpendicular relation is preferred for ease of manufacture, and to maintain the narrow profile of the extender throughout the range of pivoted motion for the body sections.

FIGS. 4 and 5 depict a socket part 40 of the conductive receptacle 29. In one aspect, the socket part 40 is bored to receive the spark plug end nut of a conventional spark plug 11. Other configurations can also be incorporated according to the form of ignition device (such as a glow plug or other ignition device) to which the extender 10 can also be attached.

Within the socket part 40 is a retainer device depicted in FIGS. 4 and 5 as a retainer spring 42 that is positioned to snap over a spark plug end nut upon placement of the extender 10 over the spark plug end. Again, while the spring arrangement 42 is functional for the intended purpose, other forms of releasable retainer arrangements can also be used.

Relative rotation between the short body section 24 and the conductive receptacle 29 can be prevented by use of a roll pin 41 as depicted in FIGS. 4 and 5. In the illustrated embodiment, the roll pin 41 is secured between the conductor section 27B and body section 24. The pin maintains alignment of the socket part 40 within the engagement end 21 of the short body section 24, to facilitate reception of a spark plug end. The roll pin 41 also prevents axial separation (along axis "X") of the body section 24 from the adjustment part 33.

It is pointed out that other arrangements can also be used to avoid relative rotation between the receptacle 29 and short body section 24, including use of an appropriate adhesive or by incorporating mating interlocking shapes in the interfitting receptacle and body section parts 23, 24.

Given the above description, installation and operation of the present extender 10 will now be discussed.

Before installing the extender 10 it is advisable to loosen the electrode 30 by removing the fitting 28 and using a tool (if necessary) to turn the electrode 30, backing the electrode end 32 away from engagement with the spindle 37 and thereby slightly releasing clamping pressure against the spindle 37. This allows for adjustment after the extender 10 is installed, and for a greater degree of flexibility as the extender 10 is being installed.

Next, the extender 10 is positioned with plug engagement end 21 over the spark plug end, and axial force (with respect to the spark plug axis) is exerted until the plug end snaps into the socket 40 and over the retainer spring 42. The extender 10 is now mounted to the spark plug.

Once mounted, the extender 10 can be rotated as desired about the axis of the spark plug, to orient the laterally offset long body section 23 in a desired position, and to select the desired angular orientation of the pivot axis 4X" about the spark plug axis. This can be done with the body sections 23, 24 in a straight, extended configuration as illustrated in FIGS. 2 and 5.

Now, with the extender 10 mounted and initially adjusted, further adaptation can be accomplished by selectively pivoting the long body section 23 and the electrode 30 therein, into a desired orientation in which the fitting 28 is situated well clear of the adjacent exhaust header or manifold surfaces. Such positioning assures that a spark plug wire 12 can be attached at a safe distance (FIG. 2) from the manifold or header to avoid damage from overheating.

When the desired orientation of the extender 10 is selected, the user can employ an appropriate tool (against the flats 35) to tighten the electrode 30 securely against the spindle 37, thereby locking the extender 10 in the selected configuration. The fitting 28 can next be replaced over the threaded end 31 of the electrode 30 and secured against the adjacent end of the long body section 23. The fitting 28 thus secures the electrode 30 from further unintentional rotation, and presents a surrogate spark plug end to the spark plug wire socket 14. This completes installation to a point where the spark plug wire 12 can be attached to the fitting 28 and electrical energy can be delivered to the associated spark plug 11.

It is noted that the adjustment features provided by the present extender 10 allow for selective orientation of the extender parts in order to accommodate various engine head, exhaust manifold, and header configurations. Even in engine head and header or exhaust manifold configurations where spark plug access is tight, and header or manifold temperature is high, the extender 10 can function to locate the attached plug wire 12 in a lower heat zone, while the high heat areas are spanned by the heat resistant and electrically insulative body 20. Uninterrupted flow of electrical energy is assured by the conductor 27 so the engine is allowed to operate in an efficient manner.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A spark plug extender for joining a spark plug to a spark plug wire, comprising:

an elongated body formed of heat resistant and electrically insulative material, extending between a spark plug engagement end, and a spark plug wire connector end;

an electrical conductor extending within the body and defining the spark plug engagement end and the spark plug wire connector end;

wherein the conductor includes a fitting at the spark plug wire connector end adapted to releasably electrically connect to a spark plug wire;

wherein the conductor also includes a conductive receptacle at the sparkplug engagement end, adapted to electrically connect to a spark plug; and an adjustment part disposed along the body between the spark plug engagement end and the spark plug wire connector end, permitting adjustable movement of the spark plug wire connector end relative to the conductive receptacle.

2. The spark plug extender of claim 1, wherein the heat resistant and electrically insulative material is rigid.

3. The spark plug extender of claim 1, further comprising a selective locking arrangement on the adjustment part and selectively operable between a locked condition wherein adjustable movement of the spark plug wire connector end relative to the conductive receptacle is inhibited, and an unlocked condition wherein the conductive receptacle is free to move relative to the spark plug wire connector end.

4. The spark plug extender of claim 1, wherein the conductor is comprised of a rigid conductive metal.

5. The spark plug extender of claim 1, wherein the conductor is comprised of a rigid conductive rod having a diameter of approximately 0.135–0.185 inches.

6. The spark plug extender of claim 1, wherein the conductor is comprised of steel and the heat resistant and electrically insulative material includes alumina oxide.

7. The spark plug extender of claim 1, wherein the fitting is situated on an end of an elongated electrode and wherein the electrode leads to an opposite end that is joined to the conductive receptacle.

8. The spark plug extender of claim 1, wherein the fitting is situated on an elongated electrode at an end thereof, and wherein the electrode leads to an opposite end that is threadably joined to a conductive bushing that is mounted to a spindle on the conductive receptacle for rotation about a pivot axis; and wherein the opposite end of the electrode is positioned to selectively engage and release the spindle upon rotation of the electrode such that the conductive receptacle can be alternatively (a) inhibited against rotation about the pivot axis relative to the electrode and (b) permitted to rotate about the pivot axis relative to the electrode.

9. The spark plug extender of claim 1, wherein the conductive receptacle is situated adjacent to the adjustment part.

10. The spark plug extender of claim 1, wherein the adjustment part is comprised of pivotably joined parts of the elongated body and the conductor which define a pivot axis that is situated adjacent to the conductive receptacle.

11. The spark plug extender of claim 1, wherein the adjustment part is comprised of pivotably joined parts of the elongated body and the conductor which define a pivot axis that is situated adjacent to the conductive receptacle; and further comprising an electrically insulative spacer hub mounted between the pivotably joined parts and encircling a part of the conductor.

12. A spark plug extender for joining a spark plug to a spark plug wire, comprising:

an elongated body formed of heat resistant and electrically insulative material and extending between a spark plug engagement end, and a spark plug wire connector end;

an electrical conductor extending within the heat resistant and electrically insulative material from the spark plug engagement to the spark plug wire connector end;

wherein the conductor includes a fitting at the spark plug wire connector end adapted to releasably electrically connect to a spark plug wire;

wherein the conductor also includes a conductive receptacle at the spark plug engagement end, adapted to electrically connect to a spark plug; and an adjustment part comprised of a pivot joint disposed along the body between the spark plug engagement end and the spark plug wire connector end, permitting adjustable movement of the spark plug wire connector end and the conductive receptacle about a pivot axis that intersects with the elongated body.

13. The spark plug extender of claim 12, and wherein the pivot joint is formed by the elongated body and the electrical conductor.

14. The spark plug extender of claim 12, and wherein the conductor includes an elongated electrode and the conductive receptacle is laterally disposed in relation to the elongated electrode.

15. The spark plug extender of claim 12, and wherein the conductor includes an elongated electrode loosely received within the heat resistant and electrically insulative material.

16. The spark plug extender of claim 12, wherein the conductor includes an elongated electrode and the conductive receptacle is laterally disposed in relation to the elongated electrode, and further wherein the adjustment part is formed by the body and the conductor along a pivot axis that is substantially perpendicular to the elongated electrode.

17. A spark plug extender for joining a spark plug to a spark plug wire, comprising:

an elongated body formed of heat resistant and electrically insulative material, and extending between a spark plug engagement end and a spark plug wire connector end;

said elongated body including two pivotably interfitting body sections joined together for pivotal movement about a pivot axis;

an electrical conductor extending within the heat resistant material to the spark plug engagement end and the spark plug wire connector end;

said conductor including two pivotably interfitting conductor sections joined together for pivotal movement substantially about said pivot axis;

wherein one conductor section includes a fitting at the spark plug wire connector end adapted to releasably electrically connect to a spark plug wire;

wherein the remaining conductor section includes a conductive receptacle at the spark plug engagement end, adapted to electrically connect to a spark plug; and wherein the interfitting sections of the body and conductor comprise an adjustment part, including a pivot joint disposed along the body between the spark plug engagement end and the spark plug wire connector end, permitting adjustable movement of the spark plug wire connector end and the conductive receptacle about said pivot axis.

18. The spark plug extender of claim 17, and wherein the one conductor section is comprised of an elongated electrode extending along an electrode axis, and wherein the pivot axis is substantially normal to the electrode axis.

19. The spark plug extender of claim 17, and wherein the one conductor section is comprised of an elongated electrode extending along an electrode axis and wherein the conductive receptacle is laterally offset from the electrode axis.

20. The spark plug extender of claim 17, and wherein the interfitting sections of the body and the conductor are disposed adjacent the spark plug engagement end.

21. The spark plug extender of claim 17, further comprising an electrically insulative spacer hub mounted between the interfitting sections of the body and receiving a part of the conductor.

22. The spark plug extender of claim 17, and wherein the heat resistant and electrically insulative material is rigid.

23. The spark plug extender of claim 17, and wherein the pivot joint is connected to a locking arrangement that is selectively operable to substantially lock the interfitting sections in selected positions about the pivot axis.

24. The spark plug extender of claim 17, and wherein the interfitting sections of the body include a combined width dimension measured along the pivot axis of about 1.25 inches, wherein one of the interfitting sections of the body includes a cross sectional dimension of about 0.5 inches, and wherein the body includes an extended length dimension of about 5 inches.

* * * * *